United States Patent [19]

Lofy

[11] Patent Number: 5,065,482

[45] Date of Patent: Nov. 19, 1991

[54] SECURING APPARATUS

[76] Inventor: Stephen J. Lofy, 2928 21st St., Bakersfield, Calif. 93301

[21] Appl. No.: 569,623

[22] Filed: Aug. 20, 1990

[51] Int. Cl.[5] ..... A43C 7/00

[52] U.S. Cl. ..... 24/712.1; 24/712.9

[58] Field of Search ..... 24/712.1, 712.2, 712.5, 24/712.9, 713.2, 713.3, 713.4, 129 R, 129 A, 129 B

[56] References Cited

U.S. PATENT DOCUMENTS

| | | | |
|---|---|---|---|
| 630,837 | 8/1899 | Anderson et al. . | |
| 994,187 | 6/1911 | Mumaw | 24/713.2 |
| 1,599,040 | 9/1926 | Clisby . | |
| 1,629,684 | 5/1927 | De Haan | 24/712.9 |
| 1,718,641 | 6/1929 | Forman . | |
| 2,035,174 | 3/1936 | McIlhenny | 24/712.2 |
| 2,266,083 | 12/1941 | Rzepa | 24/712.1 |
| 2,506,274 | 5/1950 | Maxwell et al. . | |
| 2,673,381 | 3/1954 | Dueker | 24/712.1 |
| 4,068,479 | 1/1978 | Lane, Jr. . | |
| 4,105,349 | 8/1978 | Kupperman et al. . | |
| 4,414,712 | 11/1983 | Beggins . | |
| 4,790,048 | 12/1988 | Arnt | 24/712.1 |

FOREIGN PATENT DOCUMENTS

| | | | |
|---|---|---|---|
| 610033 | 12/1960 | Canada | 24/129 |
| 38186 | 3/1913 | Sweden | 24/712.1 |
| 1457313 | 12/1976 | United Kingdom | 24/712.1 |

*Primary Examiner*—Victor N. Sakran

*Attorney, Agent, or Firm*—Worrel & Worrel

[57] ABSTRACT

A securing apparatus for drawing a pair of work objects toward each other in interoperation with a first line borne by at least one of the work objects, the apparatus having a second line for attachment to the other of the work objects; and a member having holes for attachment to the first line, holes for receiving the second line in sliding movement therethrough in such a fashion as to dispose a section of the second line in overlaying engagement with another portion of the second line whereby the second line can be drawn through its holes to draw the work objects toward each other and said section of the second line into motion resisting engagement with said other portion of the second line for releasibly securing the work objects in selected positions relative to each other.

8 Claims, 2 Drawing Sheets

SECURING APPARATUS

BACKGROUND OF THE INVENTION

1. Field of the Invention

The present invention relates to a securing apparatus and more particularly to such a securing apparatus which is adaptable to a wide variety of operative environments and which, in the preferred embodiment, is operable to permit people, such as the elderly, the disabled and the obese, conveniently and comfortably to wear shoes.

2. Description of the Prior Art

Daily activities present a multitude of difficulties to certain types of people which are not experienced by the public generally. Such mundane activities as dressing can be particularly bothersome to people lacking the degree of manual dexterity required for the operation comfortably to be performed. The fact that such activities as dressing must be performed two or more times on a daily basis and similarly require a certain attention to detail in order to present a pleasing appearance, make such activities particularly onerous. The disabled, the elderly and large or obese persons face this difficulty to one degree or another. In the case of, for example, people disabled by arthritis, this difficulty is not only acute but accompanied by varying degrees of pain which not only interferes with performance of the operation, but also drains the person of energy, particularly when performed several times during a day. Although such people may have assistance from family members, nurses, trained assistants, or the like, this is not only inconvenient but detracts from the person's sense of independence and worth.

The act of putting on and removing of shoes presents particular problems in this regard. Most shoes, whether worn by males or females, are secured on the foot by laces which require the user to grasp both ends of the lace of the shoe in their hands, draw the ends tight to draw the lace flaps toward each other, and then manipulate the lace ends so as to tie the ends together to form, for example, a bow. The manual dexterity required is frequently beyond the capability of the elderly and of disabled people, or they may lack the degree of dexterity required to perform this operation satisfactorily. In other cases, the age, disability or size of the person may make it difficult or impossible for the person to bend over sufficiently to perform the operation satisfactorily. While it is possible to provide such people with slippers, or slip on type shoes, these present other difficulties and may not provide the support, comfort or appearance desired by the person.

Therefore, it has long been known that it would be desirable to have a securing apparatus which is adapted for use in conveniently drawing a pair of work objects toward each other and which has particular utility in permitting people possessing limited manual dexterity to wear shoes of a lace type without having to perform the manipulations normally required while, at the same time, permitting the shoe to be comfortably secured on the foot, worn without risk of coming loose and removed when desired with an ease suited to the capabilities of preson wearing the shoe.

SUMMARY OF THE INVENTION

Therefore, it is the object of the present invention to provide an improved securing apparatus.

Another object is to provide such a securing apparatus which is adaptable to a wide variety of specific embodiments and for use in a wide variety of operable environments where it is desired to draw a pair of work objects toward each other and to secure them in the selected positions relative to each other without the complicated manipulations normally associated therewith.

Another object is to provide such a securing apparatus which is particularly well suited to use in securing lace type shoes on the foot of people not possessing the manual dexterity required of such an operation, such as the elderly, the disabled and large or obese people.

Another object is to provide such a securing apparatus which can be operated by a person simply by using a single hand in drawing a portion thereof in a single direction and which, conversely, can be released simply by pulling upwardly on a portion of the securing apparatus.

Another object is to provide such a securing apparatus which, when used on a shoe, interoperates with the conventional construction of the shoe to draw the bow of the tied shoe laces across the securing apparatus into the normal position of the bow on the shoe substantially to obscure the securing apparatus from observation by others.

Another object is to provide such a securing apparatus which is very inexpensive to construct, can be manufactured as an integral part of shoes at the time of manufacture or, conversely, can be retrofitted on existing shoes and operated dependably and conveniently throughout a long operational life.

Another object is to provide such a securing apparatus which is of very light weight so as not in any way to interfere with normal use of the shoes once secured on the feet.

Further objects and advantages are to provide improved elements and arrangements thereof in an apparatus, and method of manufacture for the purposes described, which are dependable, durable, and fully effective in accomplishing their intended purposes.

These and other objects and advantages are achieved, in the preferred embodiment of the apparatus of the present invention, wherein a pair of work objects are required to be drawn toward each other in interoperation with a first line borne by one of the work objects, the apparatus having a second line having means for attachment to the other of the work objects in substantially fixed relation thereto and a member having means for attachment to the first line, means for receiving the second line in sliding movement therethrough and means for releasably securing the second line in fixed relation thereto whereby the second line can be drawn through the receiving means to draw the work objects toward each other for releasibly securing the work objects in selected positions relative to each other.

DESCRIPTION OF THE PREFERRED EMBODIMENT

Figure 1:
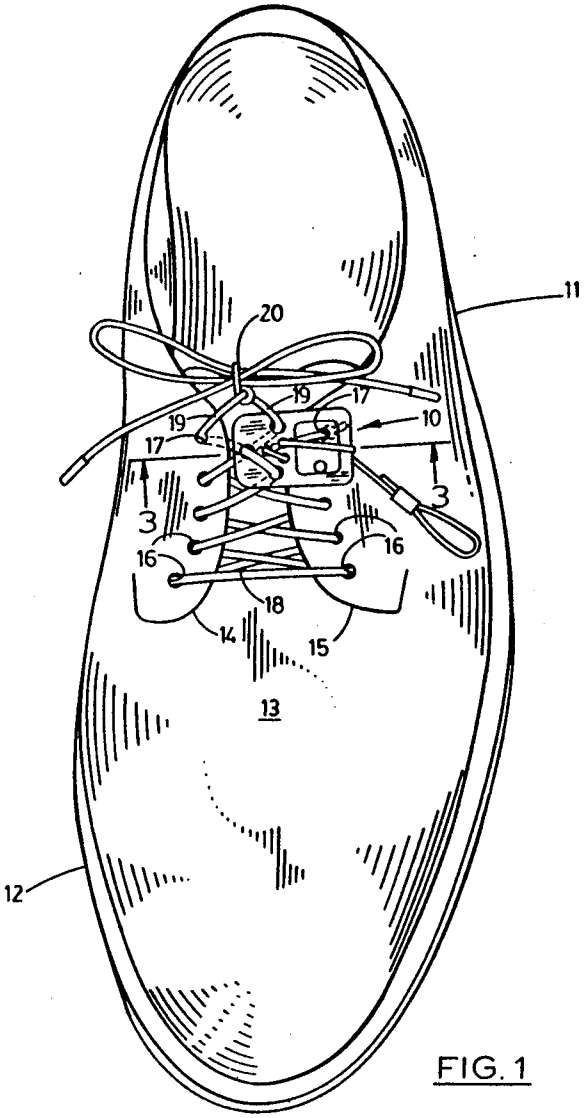
FIG. 1 is a top plan view of a conventional shoe on which the securing apparatus of the present invention has been installed and is shown in a somewhat loosened arrangement for illustrative convenience in showing the extension of the shoe lace and second line therethrough.

Referring more particularly to the drawings, the securing apparatus of the present invention is generally indicated by the numeral 10 in FIG. 1. The securing apparatus, as will become more clearly apparent, can be constructed in a wide variety of different embodiments and, similarly, can be employed in a wide variety of different environments in which a pair of work objects are to be drawn toward each other. The embodiment of the present invention shown and described herein is particularly well suited to the environment disclosed, as will hereinafter become more clearly apparent.

The securing apparatus 10, in the environment disclosed herein, is employed with a shoe 11 interoperating therewith for purposes which will subsequently become more clearly apparent. The shoe has a sole 12 on which, in the conventional manner, is mounted an upper 13. A first lace flap 14 is provided on the upper on the left as viewed, in FIGS. 1 and 2, and a second lace flap 15 is provided on the right of the upper, as viewed in FIGS. 1 and 2. Each lace flap has a plurality of lace holes 16 extending therethrough and arranged in spaced relation in the conventional manner. Each of the lace flaps can be visualized as having an upper most lace hole 17.

Figure 2:
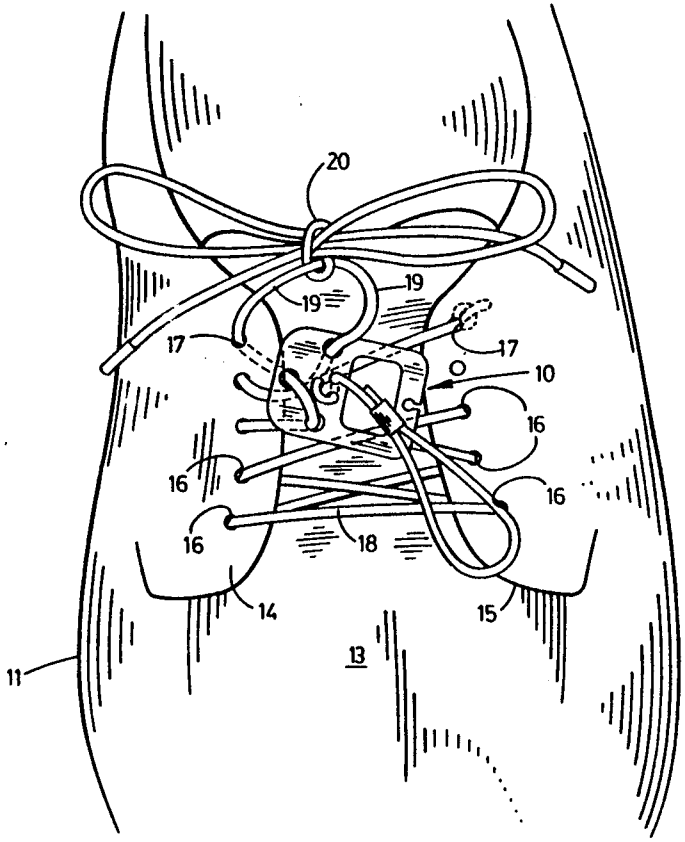
FIG. 2 is a somewhat enlarged, fragmentary, top plan view of the shoe of FIG. 1 showing, for illustrative convenience, the second line, and shoe lace in a somewhat more secure interrelationship than in FIG. 1, but with the bow elevated to expose the shoe lace and second line.

A first line or shoe lace 18 is interlaced through successive lace holes 16 of the first and second lace flaps 14 and 15 in the conventional manner, except as will hereinafter be described in connection with the securing apparatus 10. The shoe lace 18 has opposite end portions 19 and, as shown in FIGS. 1 and 2, is tied in the conventional manner to form a tie or bow 20.

Figure 4:
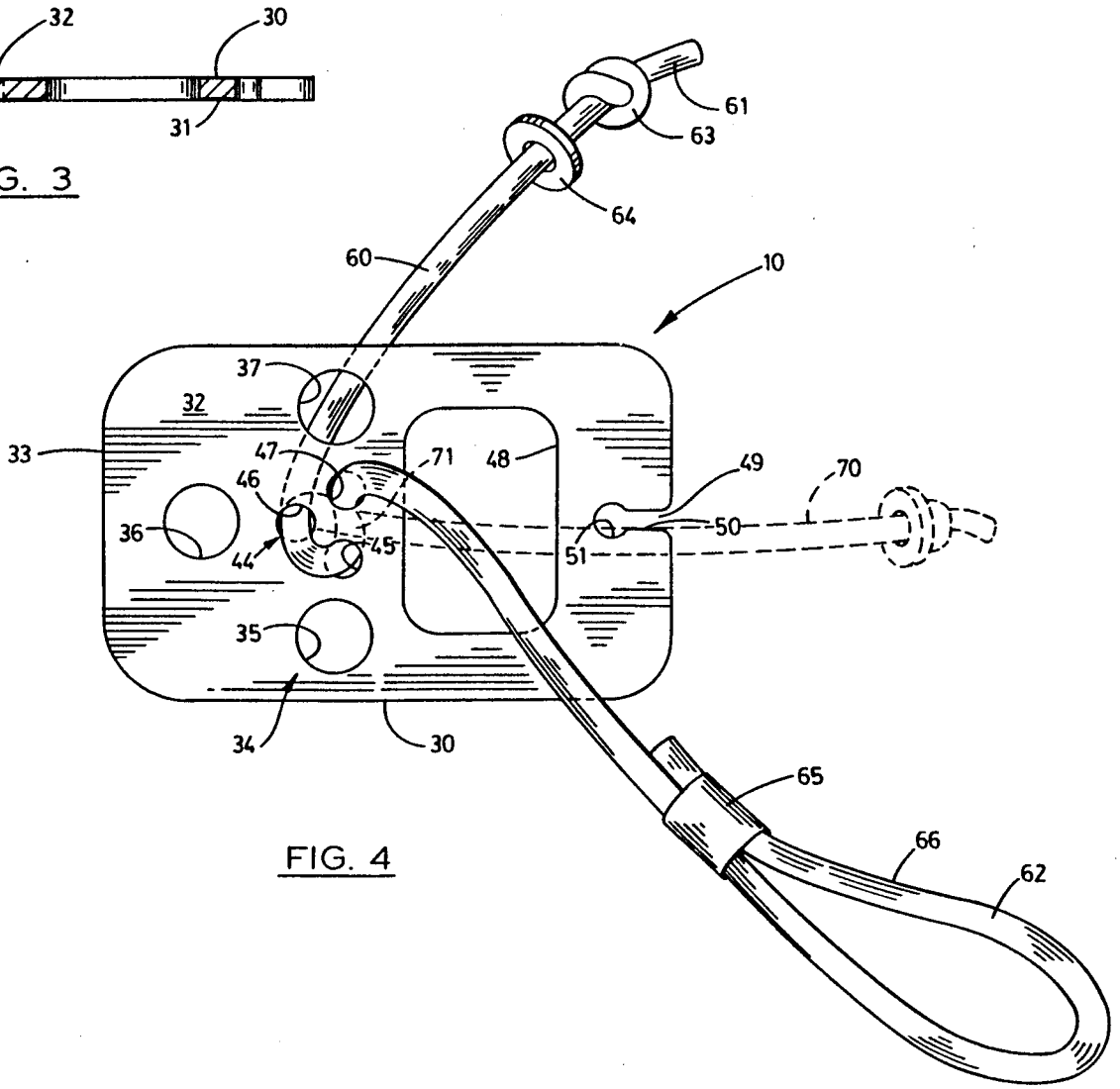
FIG. 4 is a top plan view of the securing apparatus of the present invention showing the second line in full lines in an unsecured relationship and in phantom lines in a fully secured relationship.
Figure 3:
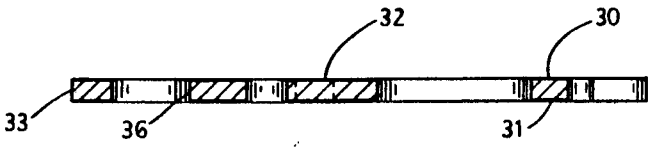
FIG. 3 is a somewhat enlarged, longitudinal section on line 3-3 in FIG. 1.

The securing apparatus 10 is shown best in FIG. 4 and consists of a substantially flat member or plate 30, having a lower surface 31 and an opposite upper surface 32. The plate may be constructed of any suitable material as may be most suited to the particular environment in which it is to be employed. In the environment shown and described herein, the plate is preferably constructed of a suitable transparent plastic material. The plate has a peripheral edge 33. A first set of holes 34 are extended through the plate in the hand portion thereof, as shown in FIG. 4. The first set of lace holes are of a diameter which is larger than the cross-sectional area of the shoe lace 18 so that the shoe lace can easily slide through the holes as will hereinafter be described. The first set of holes includes a lower hole 35, a central hole 36 and an upper hole 37.

A second set of holes 44 extend through the plate 30 in the area bounded by the first set of holes 34. The second set of holes include a lower hole 45, a central hole 46 and an upper hole 47. The holes of the second set of holes preferably individually have cross-sectional areas of smaller size than that of the first set of holes. The first and second set of holes are preferably, although not necessarily, arranged relative to each other in the pattern best shown in FIGS. 4.

The plate 30 has a main opening 48 and a notch 49 extends inwardly from the peripheral edge 33 of the plate on the right as viewed in FIG. 4. The notch is composed of a channel 50 leading to a receptacle 51. The channel and receptacle are preferably of a cross-sectional area of relatively small size, also hereinafter to be described.

The apparatus 10 has a second line 60 having a proximal end portion 61 and an opposite distal end portion 62. A knot 63 is formed in the proximal end portion of the second line and a flange member or washer 64 is slidably received about the proximal end portion for engagement with the knot. The distal end portion 62 of the second line is folded back upon itself and secured by a band 65, as shown in FIG. 4, to form a loop 66. The second line preferably has a cross-sectional area slightly smaller than that of each of the second set of holes 44 and preferably slightly larger than the cross-sectional area of the notch 49.

In the environment shown and described herein, the securing apparatus 10 is employed on the shoe 11 for purposes of assisting a person readily to secure the shoe on the foot without requiring the manual dexterity required by the conventional practice of tying the end portions 19 of the shoe lace 18 to form the bow 20.

The securing apparatus 10 is initially installed on the shoe by the disabled person or by someone assisting the disabled person. Once installed the securing apparatus does not again have to be installed and the shoe can be loosened or tightened for purposes of ingress and egress. The plate 30 is installed on the shoe lace 18 by extending the end portions 19 of the shoe lace through the first set of holes 34 as shown in FIGS. 1 and 2. More specifically, the end portion of the shoe lace extending from one of the lace holes 16 of the first lace flap 14 is passed through the lower hole 35 from the lower surface 31 through the upper surface 32 and then back through the plate through the central hole 36 from the upper surface to the lower surface. The end portion of the lace is then extended beneath the first lace flap 14 and upwardly through the upper most lace hole 17 thereof.

The end portion 19 of the shoe lace 18 extending from the second lace flap 15 is extended across the shoe and through one of the lace holes 16 of the first lace flap so as to extend outwardly thereof and beneath the lower surface 31 of the plate 30. The end portion is then extended through the upper hole 37 of the first set of holes 34 from the lower surface 31 to the upper surface thereof so as to extend outwardly through the plate in laterally disposed relation to the opposite end portion 19, as best shown in FIGS. 1 and 2. The end portions 19 of the shoe lace 18 are then tied to form a bow 20 in the conventional fashion.

Installation of the securing apparatus requires that the second line 60 be extended through the upper most lace hole 17 of the second lace flap 15 and pulled tight so that the washer 64 abuts the underside of the second lace flap beneath the upper most lace hole 17 thereof. The second line 60 is then extended beneath the lower surface 31 of the plate 30 and upwardly through the central hole 46 of the second set of holes 44 from the lower surface to the upper surface of the plate and then downwardly through the lower hole 45 from the upper surface to the lower surface of the plate. The second line is then extended upwardly through the upper hole 47 from the lower surface of the plate to the upper surface of the plate and to the position shown in FIG. 4.

It will be understood that the relative sizes of the second set of holes 44, the second line 60, the band 65 and the like can be varied to suit the circumstances. Thus, the securing apparatus can be so constructed in the relative sizes of the elements described as to be installed at the time of manufacture on the shoe 11 so as not to be removable therefrom. In this configuration the user then simply extends the shoe lace 18 through the first set of holes 34 in the manner heretofore described. In other situations, the second line can be so designed relative to the sizes employed as to permit it to be installed on a conventional shoe as a retrofitted device.

The second line 60, when loosened, is as shown in full lines in FIG. 4. When pulled tight, as will hereinafter be described, the second line occupies a position relative to the plate 30 as shown at 70 in phantom lines in FIG. 4. When in the position 70, the second line has a section 71 which extends through holes 45 and 47 across the lower surface 31 and overlays and engages the second line for purposes hereinafter described.

OPERATION

The operation of the described embodiment of the present invention is believed to be clearly apparent and is briefly summarized at this point.

Once installed as described, the shoe lace 18 can be loosened to permit the first and second lace flaps 14 and 15, respectively, to be parted simply by pulling the plate 30 away from the uppermost lace hole 17 of the second lace flap so as to permit the second line 60 to slide through the second set of holes 44. In any case, the bow 20 is left tied in the position described and may even be permanently secured by applying adhesive thereto to hold it in the tied condition.

When the person desires to put on the shoe, the foot is simply inserted in the shoe in the normal fashion. The user then pulls on the second line 60 by grasping the loop 66 and pulling it to the right as viewed in FIGS. 1 and 2. Such movement causes the second line to be drawn through the second set of holes 44 of the plate 30 and the plate to be moved toward the right as viewed therein. The end portions 19 of the shoe lace 18 are, as a consequence drawn through the first set of holes until the bow 20 overlays the plate. Continued pulling of the second line draws the first and second lace flaps 14 and 15 toward each other. When the first and second lace flaps are drawn toward each other a sufficient distance so that the shoe is secured on the foot of the wearer and is comfortable, the user simply snaps the second line 60 in the notch 49 sliding it along the channel 50 and into the receptacle 51. The second line is at this time in the position 70 shown in FIG. 4. The opposing forces cause the plate tightly to overlay the second line and thus the section 71 of the second line to engage the second line therebeneath to prevent slippage. Thus, the first and second lace flaps are secured in the position selected and cannot part. The bow 20 overlays the transparent plate 30 so that the plate is substantially completely disguised on the shoe. In this regard, it will be understood that, for illustrative convenience, the bow 20, as shown in FIGS. 1 and 2, is not disposed in the normal secured position disguising the plate, but is artificially elevated therefrom to expose the manner in which the shoe lace and second line are extended through the plate.

When it is desired to remove the shoe 11, the operator simply pulls upwardly on the loop 66 of the second line 60 to release the second line from the notch 49 so as to free the second line therefrom. The operator then pulls upwardly on the plate 30 using the main opening 48. This pulls the section 71 of the second line upwardly from the portion of the second line therebeneath and releases the second line to slide through the second set of holes 44 to release the pressure holding the first and second lace flaps 14 and 15 together. The first and second lace flaps can then move from each other permitting the shoe to be pulled free.

Therefore, the securing apparatus of the present invention is operable conveniently to draw a pair of work objects toward each other and, in the described embodiment, is operable to permit a person comfortably to put on and take off shoes which are secured by laces simply by pulling on a single line and possessing an operable configuration in which the securing apparatus is substantially fully concealed by the bow during normal use so as not to detract from the appearance of the shoes and not to be evident to others in an apparatus which is of a very light weight and inexpensive construction and which possesses a virtually unlimited number of operative environments.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desire to secure by Letters Patent is:

1. A securing apparatus for drawing a pair of work objects toward each other in interoperation with a first line borne by at least one of said work objects, the apparatus comprising a second line having means for attachment to the other of said work objects; and a substantially ridged plate having a first set of holes through which the first line can be extended while attached at other portions to said first and second work objects and a second set of holes extending through the plate through which the second line is extended in sliding movement therethrough to permit said work objects to be drawn toward each other and in such a manner as to dispose a section of the second line beneath said plate in overlaying relation to another portion of the second line to impart sufficient resistance substantially to prevent movement of the second line relative to the plate thus retaining the work objects substantially in the positions relative to each other they are at the time said drawing of the second line is terminated.

2. The securing apparatus of claim 1 wherein said work objects are the lace flaps of a shoe having lace holes, the first line is the shoe lace of the shoe interlaced in the lace holes of both of said lace flaps and through said first set of holes and tied in a bow or the like whereby the plate can be moved so as to remove said section of the second line from overlaying engagement with said other portion of the second line permitting the lace flaps to move from each other while the shoe lace remains tied in a bow or the like, for ease of ingress and egress to the shoe and, when it is desired to secure the shoe on the foot within the shoe, the user can with one hand draw the second line through said second set holes to draw the lace flaps toward each other and into selected secured relation on the foot held in the selected position by engagement of said section of the second line with the other portion of the second line therebeneath.

3. The securing apparatus of claim 2 wherein said shoe lace has opposite end portions, one end portion of said shoe lace is extended through two of said first set of holes and through the upper most lace hole of one of said lace flaps, the other end portion of the shoe lace is extended through another of said first set of holes spaced from said upper most lace hole in the direction of said other of said lace flaps and the end portions are tied therebetween in said bow or the like and the second line is secured in the upper most lace hole of the other of said lace flaps, whereby when the second line is drawn through said second holes of the plate to draw said lace flaps toward each other the bow or the like is drawn over said plate substantially to obscure said plate in the conventional position therefore.

4. The securing apparatus of claim 3 wherein said attachment means of the second line is a stop member borne by the second line adjacent to an end thereof whereby the stop engages the underside of the lace flap when the second line is extended through said upper most lace hole to prevent movement of the second line from said upper most lace hole.

5. The securing apparatus of claim 4 including a loop formed in said second line adjacent to the opposite end of said second line from said stop member.

6. The securing apparatus of claim 3 wherein said plate has a notch dimensioned to receive said second line in secured relation.

7. A securing apparatus for drawing a pair of work objects toward each other in interoperation with a first line borne by at least one of said work objects, the apparatus comprising a member having a first set of holes through which said first line can be extended and a second set of holes extending through the member; and a second line having means for attachment to the other of said work objects and slidably extended through said second set of holes in such a manner as to dispose a portion of the second line in overlaying relation to another portion of the second line whereby said second line can be pulled through said second set of holes to draw said work objects toward each other while said portions of the second line impart sufficient resistance substantially to prevent movement of the second line relative to the member once said drawing of the second line is terminated thus retaining the work objects substantially in the positions relative to each other achieved by such drawing.

8. The securing apparatus of claim 7 wherein said member has a notch dimensioned to receive said second line in secure relation.

* * * * *

UNITED STATES PATENT AND TRADEMARK OFFICE

CERTIFICATE OF CORRECTION

PATENT NO. : 5,065,482

DATED : November 19, 1991

INVENTOR(S) : STEPHEN J. LOFY

It is certified that error appears in the above-identified patent and that said Letters Patent is hereby corrected as shown below:

Column 1, line 64, delete "of preson" and substitute ---of the person---.

Column 3, line 51, after "plate in the", insert ---left---.

Column 3, line 66, delete "FIGS." and substitute ---FIG.---.

Signed and Sealed this

Second Day of March, 1993

*Attest:*

STEPHEN G. KUNIN

*Attesting Officer*

*Acting Commissioner of Patents and Trademarks*